US007271682B1

(12) United States Patent
Blacka

(10) Patent No.: US 7,271,682 B1
(45) Date of Patent: Sep. 18, 2007

(54) WIDEBAND TEMPERATURE-VARIABLE ATTENUATOR

(75) Inventor: Robert J. Blacka, Pennsauken, NJ (US)

(73) Assignee: Altera Corporation, San Jose, CA (US)

( * ) Notice: Subject to any disclaimer, the term of this patent is extended or adjusted under 35 U.S.C. 154(b) by 200 days.

(21) Appl. No.: 11/107,556

(22) Filed: Apr. 15, 2005

(51) Int. Cl.
*H01P 1/22* (2006.01)

(52) U.S. Cl. ..... 333/81 A; 338/216

(58) Field of Classification Search ..... 333/81 A, 333/81 R, 22 R; 338/216
See application file for complete search history.

(56) References Cited

FOREIGN PATENT DOCUMENTS

JP 2000196395 A * 7/2000

* cited by examiner

*Primary Examiner*—Stephen E. Jones
(74) *Attorney, Agent, or Firm*—Morgan, Lewis & Bockius LLP

(57) ABSTRACT

The present invention is a wideband temperature-dependent attenuator. In a preferred embodiment the attenuator is a modified Tee attenuator having first and second resistors connected in series at a first node and third and fourth resistors connected in shunt between the first node and ground. In a physical implementation of the attenuator, the third and fourth resistors are on opposite sides of the first and second resistors. Preferably, each of the four resistors is formed as a thick film resistor.

18 Claims, 5 Drawing Sheets

WIDEBAND TEMPERATURE-VARIABLE ATTENUATOR

CROSS REFERENCE TO RELATED APPLICATION

Related applications are application Ser. No. 10/912,726, filed Aug. 5, 2004, for "Wideband Temperature Variable Attenuator," and application Ser. No. 11/107,586, filed concurrently herewith, for "Voltage Controlled Attenuator with No Intermodulation Distortion," both of which disclosures are incorporated by reference herein.

FIELD OF INVENTION

The invention relates to wideband temperature-variable microwave attenuator.

BACKGROUND OF THE INVENTION

Attenuators are used in applications that require signal level control. Level control can be accomplished by either reflecting a portion of the input signal back to its source or by absorbing some of the signal in the attenuator itself. The latter is often preferred because the mismatch which results from using a reflective attenuator can create problems for other devices in the system such as nonsymmetrical two-port amplifiers. It is for this reason that absorptive attenuators are more popular, particularly in microwave applications. The important parameters of an absorptive attenuator are: attenuation as a function of frequency; return loss; and stability over time and temperature.

It is known that variations in temperature can affect various component parts of a microwave system causing differences in signal strengths at different temperatures. In many cases, it is impossible or impractical to remove the temperature variations in some Radio Frequency (RF) components. For example, the gain of many RF amplifiers is temperature dependent. In order to build a system with constant gain, a temperature-dependent attenuator is placed in series with the amplifier. The attenuator is designed such that a temperature change that causes the gain of the amplifier to increase will simultaneously cause the attenuation of the attenuator to increase such that the overall gain of the amplifier-attenuator system remains relatively constant. However, prior art temperature-dependent attenuators do not offer the bandwidth needed for certain wideband applications.

Voltage controlled attenuators (VCAs) are a fairly common element of almost any RF or microwave circuit. Their function is to change the amplitude of a signal based on some external signal, usually a voltage or current. A common use is the leveling of a signal so that both strong and weak signals can be adjusted in amplitude to provide a constant level signal to the next stage of the circuit. Another use is the balancing of multiple signal paths so they all have the same gain. A third use would be to use a VCA to control the gain of an amplifier over temperature by varying the control voltage based on a measurement of the ambient temperature. This last use is to counter undesired changes to the gain of the amplifier when the ambient temperature changes.

The vast majority of presently available VCAs include either diodes, transistors, or FETs (field effect transistors). These active devices have non-linear transfer characteristics which result in distortion to RF and microwave input signals. This causes additional and unwanted signals to be generated which are not present in the original signal. These additional signals have the potential of causing interference to other services, like police or fire departments that use the same frequencies as the additional signals.

U.S. Pat. No. 5,332,981, issued to Joseph B. Mazzochette, et al., issued Jul. 26, 1994, entitled "Temperature Variable Attenuator," which is incorporated herein by reference, describes an attenuator that includes temperature variable resistors (thermistors) in the attenuating path. As shown in FIGS. 1A and 1B which are reproduced from FIGS. 1 and 3 of the '981 patent. conventional attenuators include a Tee attenuator 10 comprising a pair of identical series resistors R1 and a shunt resistor R2 and a Pi attenuator 12 comprising a series resistor R2 and two shunt resistors R1 and R3. FIG. 1C is a plot reproduced from FIG. 2 of the '981 patent, showing a family of constant attenuation curves from 1 to 10 dB and a constant 50 ohm impedance curve descending from the upper left of the plot to the lower right. The vertical axis on this plot represents the value of shunt resistor R2 in the T attenuator 10 and the horizontal axis represents the values of series resistors R1. The point of intersection between the 50 ohm impedance curve and an attenuation curve gives the value of R1 and R2 that produce the attenuation represented by the attenuation curve and a 50 ohm impedance match.

In the temperature variable attenuator of the '981 patent, the temperature coefficient of resistance (TCR) of at least one resistor is different such that the attenuation of the attenuator changes at a controlled rate with changes in temperature while the impedance of the attenuator remains within acceptable levels.

While such prior art temperature-dependent attenuators have enjoyed considerable success in many applications, they do not offer the bandwidth needed for certain wideband applications.

SUMMARY OF THE INVENTION

The present invention is a wideband temperature-dependent attenuator. In a preferred embodiment the attenuator is a modified Tee attenuator having first and second resistors connected in series at a first node and third and fourth resistors connected in shunt between the first node and ground. In a physical implementation of the attenuator, the third and fourth resistors are on opposite sides of the first and second resistors. Preferably, each of the four resistors is formed as a thick film resistor.

To provide the desired temperature dependent characteristics, at least one of the resistors and preferably more has a resistance that varies with temperature. The temperature coefficients of resistance (TCR) are selected such that the attenuator changes attenuation at a desired rate with changes in temperature while the impedance of the attenuator remains within acceptable levels over the operating temperature and frequency ranges of interest. In some cases acceptable levels are such that the voltage standing wave ratio is less than 2.0 to 1.

In one embodiment, the temperature-dependent attenuator has a negative TCR, and in another embodiment it has a positive TCR. One or more of the resistors may have negative TCRs, and one or more of the resistors may have positive TCRs. At least one resistor should have a TCR that differs from the TCRs of the other resistors.

Advantageously, numerous attenuators are made simultaneously by printing thick-film resistors on an insulating substrate such as alumina and firing them. To maximize the number of attenuators that can be formed on the substrate, the attenuators are aligned in a rectangular array. Starting with a bare substrate, in a preferred embodiment via holes are drilled at the 6 o'clock and 12 o'clock positions for each attenuator and are then filled with a conductive ink. Next, one surface of the substrate is printed with a metallization layer. The opposite surface is then printed with five contact areas at the location of each attenuator. One of these contact areas is in the center of the attenuator and the other four are at the 3 o'clock, 6 o'clock, 9 o'clock and 12 o'clock positions. Thick film resistors having a positive TCR are then printed followed by printing of thick film resistors having a negative TCR. Each attenuator is then tested to determine the resistance of its resistors and the resistors are laser trimmed to meet the resistance specifications for the attenuator. Finally, a protective coating is applied to the upper surface of the attenuators, the substrate is scribed, and the individual attenuators are separated from the substrate.

BRIEF DESCRIPTION OF DRAWING

These and other objects, features and advantages of the invention will be more readily apparent from the following detailed description in which.

DETAILED DESCRIPTION

Figure 1A:
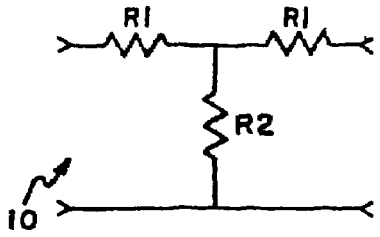
Fig. 1A (Prior Art)
FIGS. 1A-1C depict aspects of prior art attenuators.
Figure 1B:
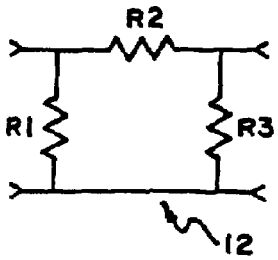
Fig. 1B (Prior Art)
Figure 2:
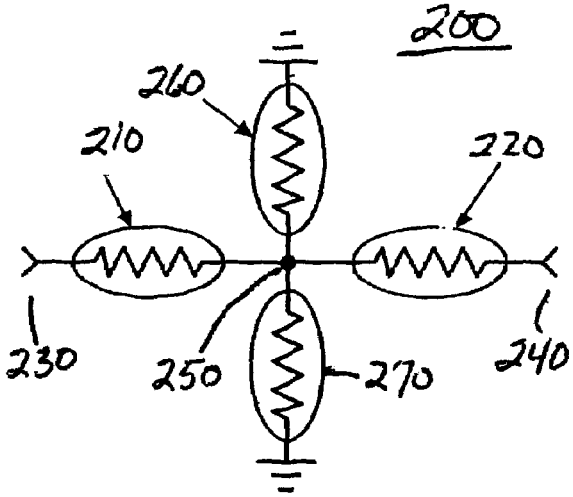
FIG. 2 is a schematic circuit diagram of a preferred embodiment of the invention.
Figure 1C:
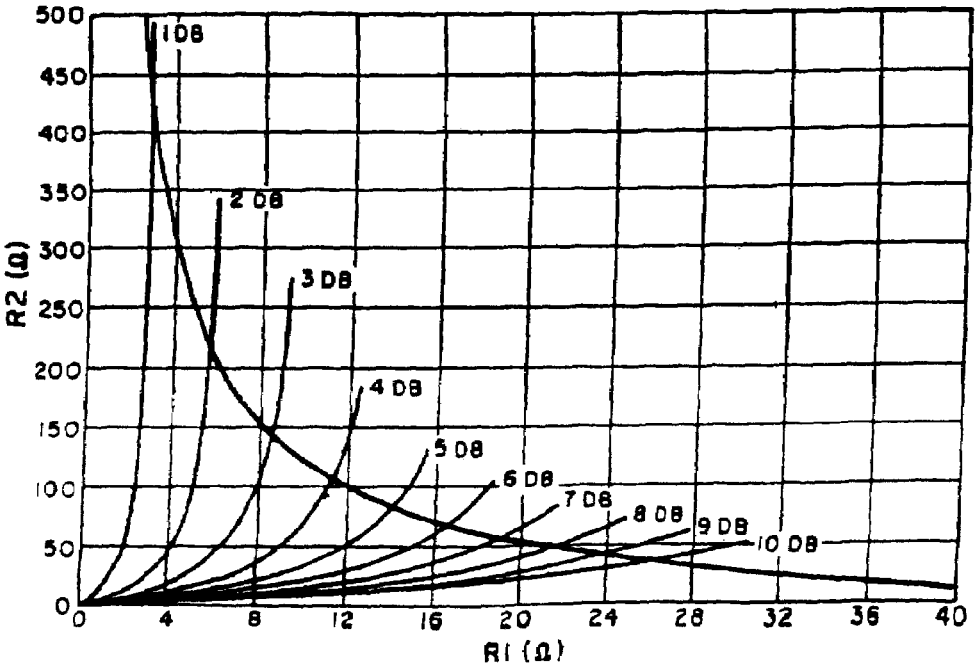
Fig. 1C (Prior Art)

FIG. 2 is a schematic circuit diagram depicting a preferred embodiment of an attenuator 200 of the present invention. Attenuator 200 comprises first and second resistors 210, 220 connected in series between an RF input 230 and an RF output 240. Resistors 210, 220 are connected together at node 250. Third and fourth shunt resistors 260, 270 are connected in parallel between node 250 and ground.

For a nominal 3 dB attenuation, each series resistor 210, 220 has a resistance of 8.55 ohms at 25° C.; and each shunt resistor 260,270 has a resistance of 283.8 ohms at 25° C. In a preferred embodiment, each of the four resistors has a non-zero temperature coefficient of resistance (TCR) and in a preferred embodiment the series resistors have a positive TCR and the shunt resistors have a negative TCR.

Other arrangements may also be used. In general, at least of the resistors must have a TCR that is different from that of the other resistors in order to meet the impedance requirements for the attenuator. However, the impedance requirements can be met in some attenuators in which at least one of the resistors has a TCR of zero. As will be appreciated, the impedance that is observed over the operating frequency range and/or temperature range of the attenuator will not be precisely constant and the variation in impedance will depend on the amount of attenuator provided by the attenuator. At low attenuation, deviation from the desired impedance may be within +/−a few percent of the desired impedance over the operating range. At higher attenuations, deviation from the desired impedance can be expected to be higher, for example +/−10%, +/−20% and even +/−50% or more in some cases. In practice, considerable variation in impedance may be tolerated depending on the specific application in which the attenuator is used and the temperature and frequency range of use. As a rule of thumb, the variation in impedance of the attenuator should be such that the Voltage Standing Wave Ratio (VSWR) of the RF power is no more than 2.0:1 over the operating range of the attenuator.

Figure 3:
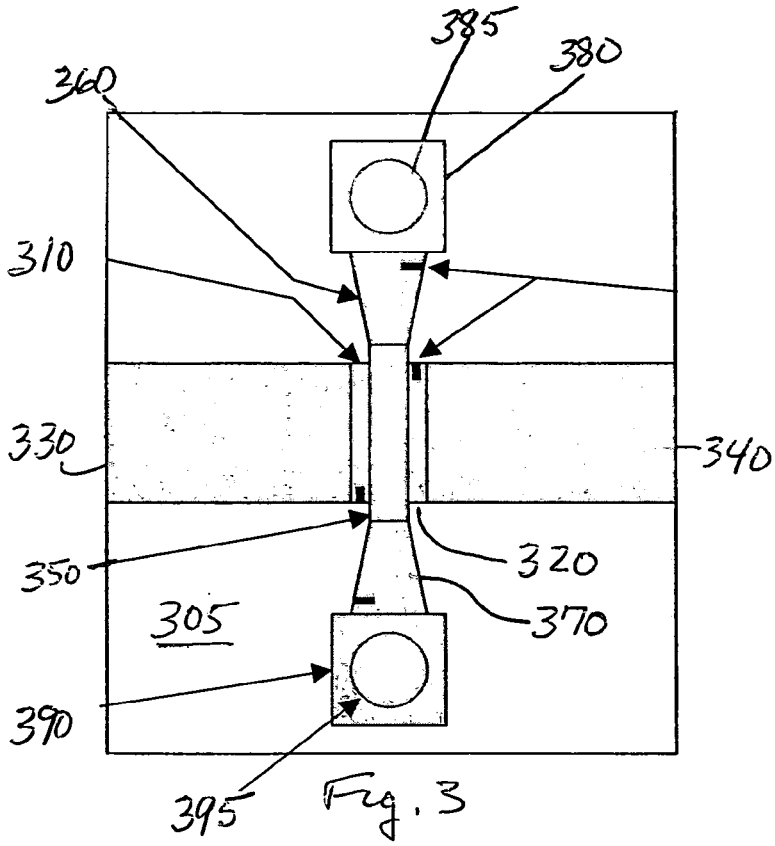
FIG. 3 is a top view of a physical implementation of the invention of FIG. 1.
Figure 4:
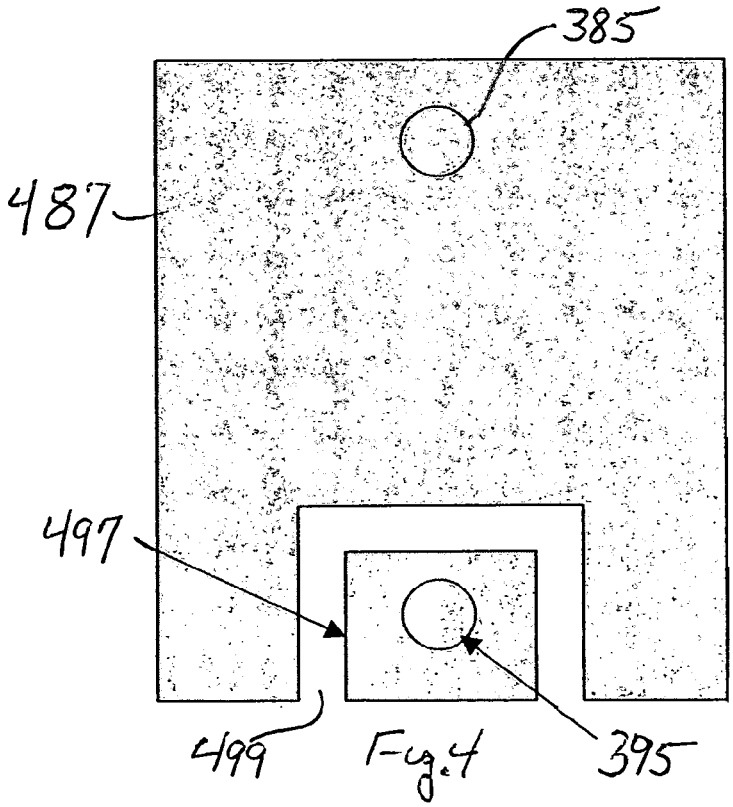
FIG. 4 is a bottom view of the physical implementation of the invention of FIG. 1.

FIGS. 3 and 4 depict top and bottom views of an attenuator 300 that is a physical embodiment of the attenuator 200 of FIG. 2. Attenuator 300 is implemented on a substrate 305 of an insulating material such as alumina, aluminum nitride, beryllium oxide, CVD diamond or a glass-epoxy laminate. In a preferred embodiment the attenuator measures about 0.060 inches by 0.070 inches and is about 0.015 inches thick. In the top view of FIG. 3, attenuator 300 has series resistors 310, 320 connected in series between input/output RF contacts 330, 340 on the upper surface of a substrate 305. The series resistors are connected at center pad 350. Shunt resistors 360, 370 are connected in parallel between center pad 350 and ground contacts 380, 390. In the planar configuration of attenuator 300, the two shunt resistors are advantageously formed on opposite sides of the series resistors. Each ground contact 380, 390 is electrically connected by a filled via 385, 395, respectively, to metallization on a lower surface of substrate 305 shown in FIG. 4.

In one embodiment, the resistors 310, 320, 360, 370 are thick film resistors produced by inks combining a metal powder, such as, bismuth ruthenate, with glass frit and a solvent vehicle. This solution is printed on the substrate and then fired at an appropriate temperature in the range of 600° C. to 900° C. When the resistor is fired, the glass frit melts and the metal particles in the powder adhere to the substrate, and to each other. This type of a resistor system can provide various ranges of material resistivities and temperature characteristics can be blended together to produce many different combinations.

The resistive characteristics of a thick film ink are specified in ohms-per-square (Ω/□). A particular resistor value can be achieved by either changing the geometry of the resistor or by blending inks with different resistivity. The resistance can be fine-tuned by varying the fired thickness of the resistor. This can be accomplished by changing the deposition thickness and/or the firing profile. Similar techniques can be used to change the temperature characteristics of the ink.

The temperature coefficient of the resistive ink defines how the resistive properties of the ink change with temperature. The Temperature Coefficient of Resistance (TCR) is often expressed in parts per million per degree Centigrade (PPM/C). The TCR can be used to calculate directly the amount of shift that can be expected from a resistor over a given temperature range. Once the desired TCR for a particular application is determined, it can be achieved by blending appropriate amounts of different inks. As with blending for sheet resistance, a TCR can be formed by blending two inks with TCR's above and below the desired TCR. One additional feature of TCR blending is that positive and negative TCR inks can be combined to produce large changes in the TCR of the resulting material.

Some thermistors exhibit a resistance hysteresis as a function of temperature. If the temperature of the resistor is taken beyond the crossover point at either end of the hysteresis loop, the resistor will retain a memory of this condition. As the temperature is reversed, the resistance will not change in the same manner observed prior to reaching the crossover point. In one embodiment, to avoid this problem, the inks used in producing a temperature variable attenuator are selected with crossover points that are beyond the typical operating range of −55° C. to 125° C.

As shown in FIG. 4, a metal layer 487 or 497, surrounds each via 385 or 395, respectively, and makes electrical contact with it. The metal layers are separated from each other by a gap 499. Preferably, the metal layers are gold.

Figure 5:
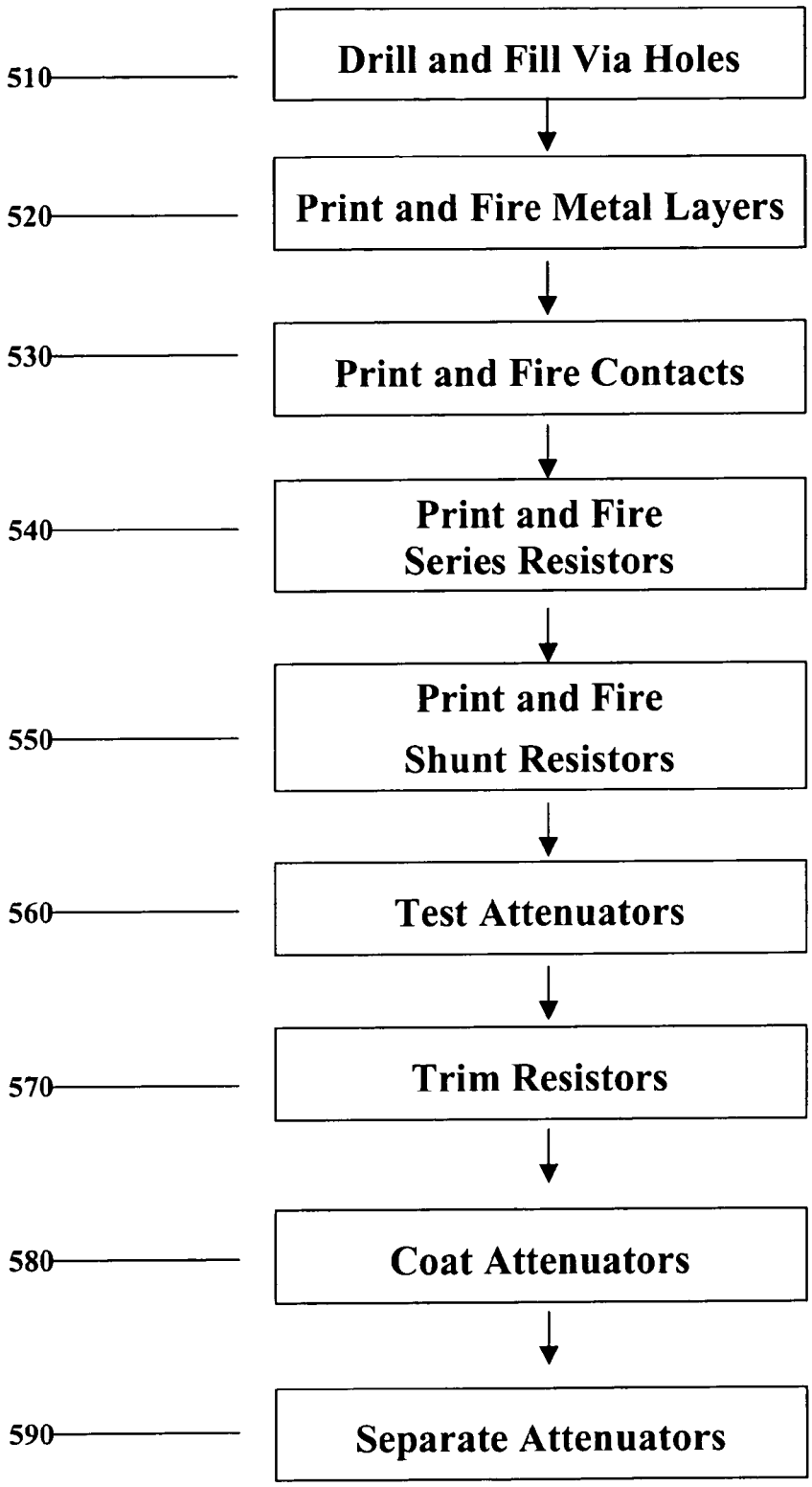
FIG. 5 is a flow chart depicting steps for forming the implementation of FIGS. 2 and 3.

Advantageously, numerous attenuators are made simultaneously by printing the contacts, center pads and resistors on an insulating substrate in a process depicted in FIG. 5. Illustratively, the substrate measures 3 inches by 3 inches and is approximately 0.015 thick. To maximize the number of attenuators that are formed at the same time, the attenuators are aligned on the substrate in a rectangular array. At step 510, two via holes are drilled in the substrate for each attenuator that is to be formed and the via holes are filled with a conductive ink and fired at the appropriate firing temperature. A metal layer is then printed at step 520 on one surface of the substrate and fired. Advantageously the metal layer as printed includes gap 499 between each pair of via holes. Next, at step 530, contacts 330, 340, 380, 390 and contact pads 350 are printed on the upper surface of the substrate and fired. The series resistors are then printed and fired at step 540 followed by the printing and firing of the shunt resistors at step 550. As will be apparent to those skilled in the art, the order in which these steps are performed may be varied. In addition, some of the firing steps may be combined.

Each attenuator is then tested at step 560 to determine the resistance of its resistors and the resistors are laser trimmed at step 570 to meet the resistance specifications for the attenuator. Finally, a protective coating is applied to the upper surface of the attenuator at step 580 and the substrate is scribed and individual attenuators are separated from the substrate at step 590.

The attenuators are then ready to be mounted in a circuit. At the time of mounting, the metal layers on the bottom surface of the substrate are soldered to a ground place on a circuit board thereby connecting the ground contacts 360, 370 to ground and the RF contacts are connected by wire bonding to transmission lines.

Figure 6:
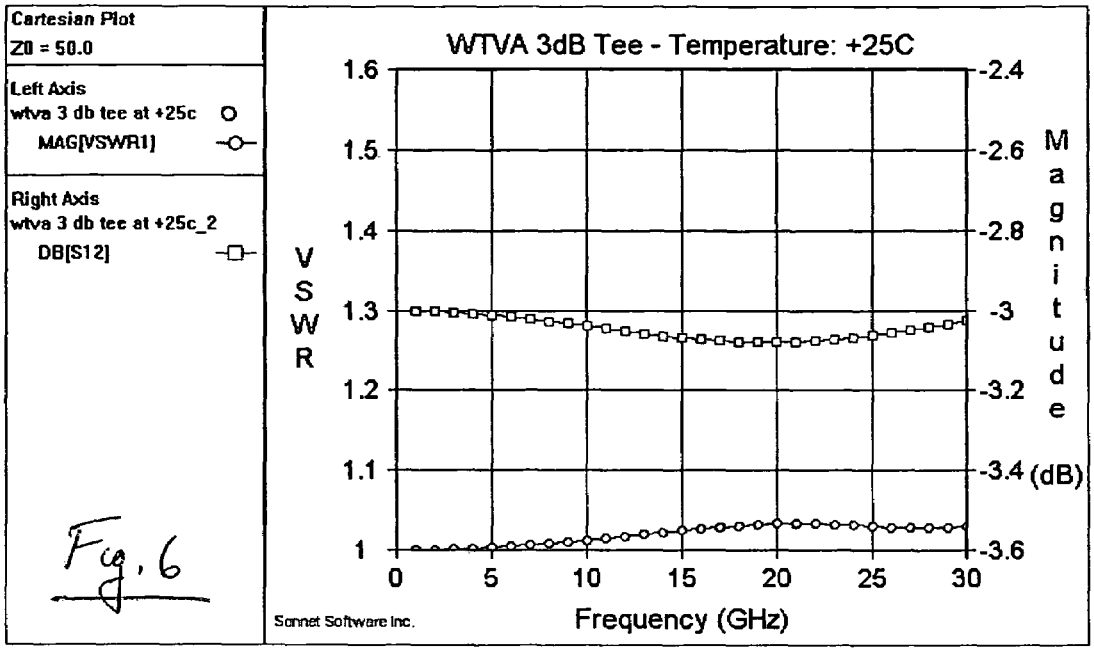
FIGS. 6-8 are simulated response curves depicting the variation of voltage standing wave ratio and attenuation with frequency at three different temperatures.
Figure 7:
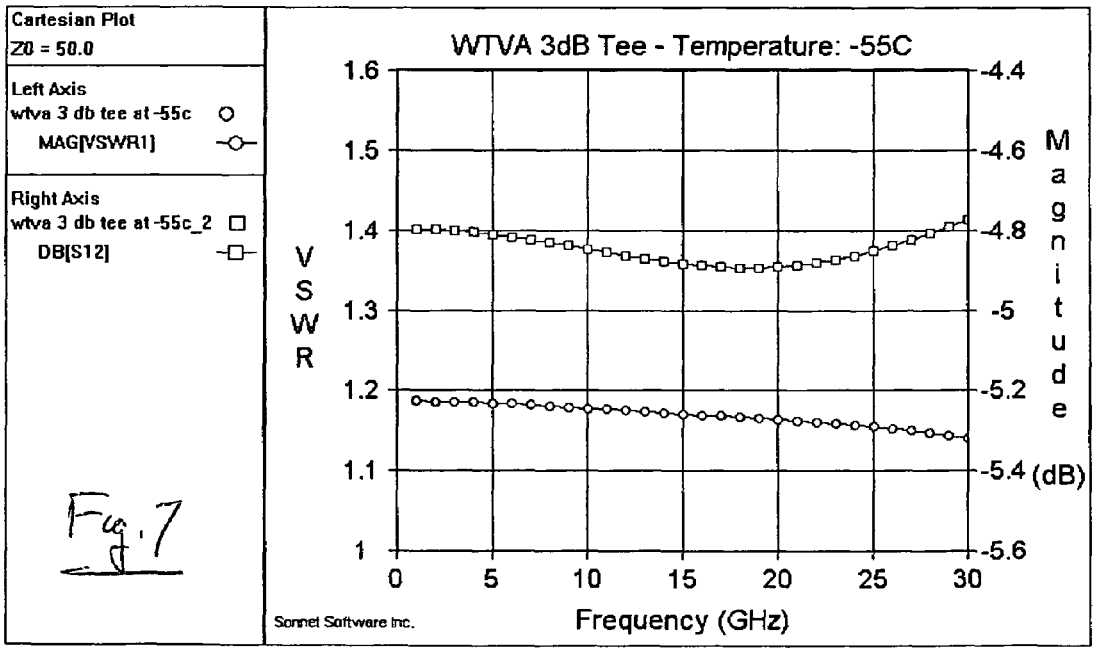
Figure 8:
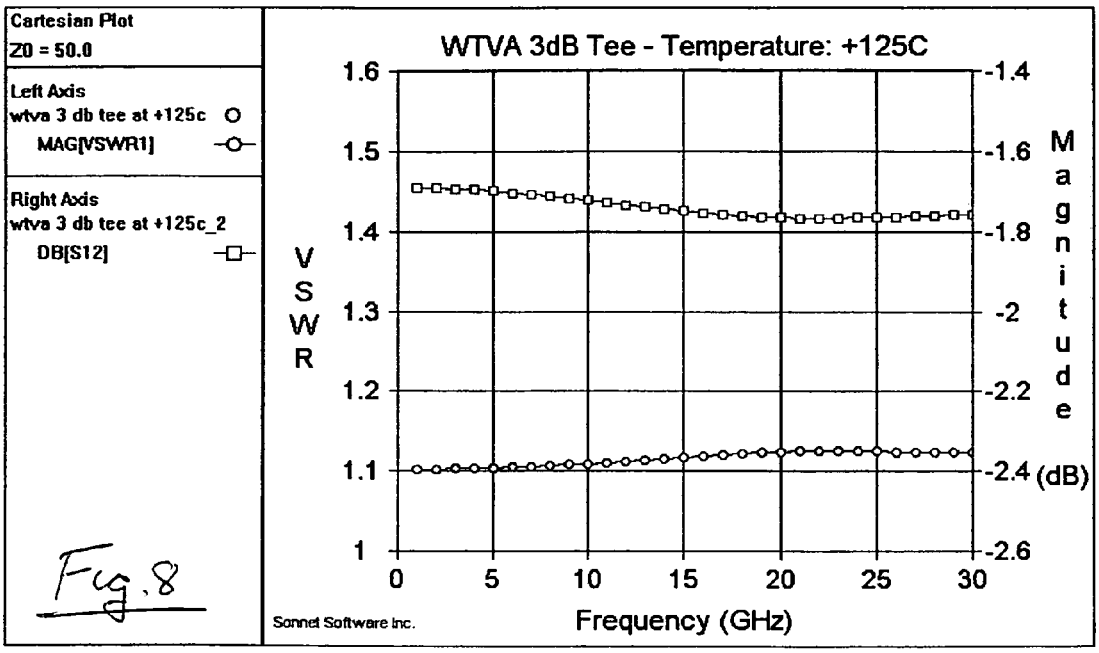

FIGS. 6, 7 and 8 are graphs depicting the variation of voltage standing wave ratio (VSWR) and attenuation with frequency at three different temperatures. As shown in FIG. 6, at a temperature of 25° C., the VSWR range from about 1.3 to 1.25 over the 50 MHz to 30 GHz operating range of the attenuator and the attenuation ranges from about 3.6 deciBels to about 3.55 deciBels over that operating range.

As shown in FIG. 7, at a temperature of −55° C., the VSWR range from 1.4 to about 1.35 over the operating range and the attenuation ranges from a little more that 5.2 deciBels to a little more that 5.3 deciBels. As shown in FIG. 8, at a temperature of 125° C., the VSWR ranges from about 1.45 to about 1.41 and the attenuation from about 2.4 deciBels to about 2.35 deciBels.

The percent invention may be implemented in a variety of forms without departing from the spirit and scope of the invention. For example, thin film resistors can be used in place of thick-film resistors. And the film resistors can be printed on low temperature co-fired ceramic substrates instead of the ceramic substrate described above.

What is claimed is:

1. A wideband attenuator comprising:

first and second resistors connected in series at a first node; and third and fourth resistors connected in shunt between the first node and ground, wherein at least one of the resistors has a temperature coefficient of resistance that differs from the temperature coefficient of resistance of the other resistors such that the attenuator has an attenuation that varies with temperature while having an impedance that varies within a range such that the attenuation has a voltage standing wave ratio of less than 2.0 to 1.

2. The attenuator of claim 1 wherein the first and second resistors are thick film resistors.

3. The attenuator of claim 1 wherein the first and second resistors have a positive temperature coefficient of resistance.

4. The attenuator of claim 1 wherein the third and fourth resistors are thick film resistors.

5. The attenuator of claim 1 wherein the third and fourth resistors have a negative temperature coefficient of resistance.

6. The attenuator of claim 1 wherein the resistors are thin-film resistors.

7. The attenuator of claim 1 wherein the first and second resistors are connected between a signal input and a signal output.

8. A wideband attenuator comprising:

first and second film resistors disposed on a first surface of a substrate and connected in series at a first node, the first and second resistors being located on a first axis;

third and fourth film resistors disposed on the first surface of the substrate and connected in shunt between the first node and ground, said third and fourth resistors being located on opposite sides of the first axis, wherein at least one of the resistors has a temperature coefficient of resistance that differs from the temperature coefficient of resistance of the other resistors such that the attenuator has an attenuation that varies with temperature while having an impedance that varies within a range such that the attenuation has a voltage standing wave ratio of less than 2.0 to 1.

9. The attenuator of claim 8 wherein the first and second resistors are thick film resistors.

10. The attenuator of claim 8 wherein the first and second resistors have a positive temperature coefficient of resistance.

11. The attenuator of claim 8 wherein the third and fourth resistors are thick film resistors.

12. The attenuator of claim 8 wherein the third and fourth resistors have a negative temperature coefficient of resistance.

13. The attenuator of claim 8 wherein the resistors are thin-film resistors.

14. The attenuator of claim 8 wherein the first and second resistors are connected between a signal input and a signal output.

15. A method of forming a temperature variable attenuator comprising the steps of:

printing five contact areas per attenuator on a first surface of a substrate, four of said contact areas being on a periphery of the attenuator and a fifth contact area being in a center of the attenuator, printing on the substrate four film resistors each of said resistors contacting the fifth contact area and one of the contact areas on the periphery of the attenuator, wherein at least one of the resistors has a first temperature coefficient of resistance and at least another of the resistors has a second temperature coefficient of resistance, the first and second temperature coefficients of resistance being selected such that the attenuator has an attenuation that varies with temperatures while having an impedance that varies within a range such that the attenuator has a voltage standing wave ratio of less than 2.0 to 1.

16. The method of claim 15 further comprising the steps of forming a metallization layer on a second surface of the substrate and connecting to the metallization layer two of the resistors connected to opposite sides of the fifth contact area.

17. The method of claim 15 wherein two of the four contact areas on the periphery of the attenuator are located on a first axis running through the fifth contact area and another two of the four contact areas on the periphery of the attenuator are located on opposite sides of the first axis.

18. The method of claim 15 further comprising the step of electrically connecting the two peripheral contact areas located on opposite sides of the first axis.

* * * * *

UNITED STATES PATENT AND TRADEMARK OFFICE

CERTIFICATE OF CORRECTION

PATENT NO. : 7,271,682 B1
APPLICATION NO. : 11/107556
DATED : September 18, 2007
INVENTOR(S) : Robert J. Blacka It is certified that error appears in the above-identified patent and that said Letters Patent is hereby corrected as shown below:

Title page, item "(73) Assignee:", replace "Altera Corporation, San Jose CA (US)" with --Smiths Interconnect Microwave Components, Inc., Stuart, FL (US)--

Signed and Sealed this

Twenty-third Day of September, 2008

JON W. DUDAS
*Director of the United States Patent and Trademark Office*